United States Patent [19]

Choulat

[11] Patent Number: 5,065,376

[45] Date of Patent: Nov. 12, 1991

[54] WRISTWATCH WITH REMOVABLE AND INTERCHANGEABLE STRAP

[75] Inventor: Jean-Pierre Choulat, Neuchâtel, Switzerland

[73] Assignee: Produsta S.A., Switzerland

[21] Appl. No.: 459,797

[22] PCT Filed: Jun. 27, 1989

[86] PCT No.: PCT/CH89/00125

§ 371 Date: Feb. 27, 1990

§ 102(e) Date: Feb. 27, 1990

[87] PCT Pub. No.: WO90/00272

PCT Pub. Date: Jan. 11, 1990

[30] Foreign Application Priority Data

Jul. 1, 1988 [CH] Switzerland ..... 2522/88

[51] Int. Cl.[5] ..... G04B 37/00

[52] U.S. Cl. ..... 368/282

[58] Field of Search ..... 368/282, 280, 281, 276

[56] References Cited

U.S. PATENT DOCUMENTS

| | | | |
|---|---|---|---|
| 2,219,277 | 10/1940 | Kaufmann | 368/282 |
| 3,189,096 | 2/1940 | Alonge | 368/282 |
| 3,492,809 | 2/1970 | Gisiger-lusa | 368/282 |
| 4,167,850 | 9/1979 | Schneider | 368/282 |
| 4,229,936 | 10/1980 | Schneider et al. . | |
| 4,742,503 | 5/1988 | Braun et al. | 368/282 |
| 4,958,527 | 9/1990 | Proellochs | 368/282 |
| 4,964,092 | 10/1990 | Brida | 368/282 |

FOREIGN PATENT DOCUMENTS

| | | |
|---|---|---|
| 2097572 | 3/1972 | France . |
| 594380 | 1/1978 | Switzerland . |

*Primary Examiner*—Bernard Roskoski

*Attorney, Agent, or Firm*—Woodard, Emhardt, Naughton, Moriarty & McNett

[57] ABSTRACT

A wristwatch, comprised of a strap including a housing for a module, the module and a ring fastener, the profiled extremities of which cooperate with the toes of the module to secure the module. Two parts of a clasp are linked to the strap by means of two excentrical clamps. The clasp allows the developed length of the wristwatch to be adjusted.

4 Claims, 2 Drawing Sheets

WRISTWATCH WITH REMOVABLE AND INTERCHANGEABLE STRAP

The present invention is concerned with a wristwatch with a removable and interchangeable strap.

BACKGROUND OF THE INVENTION

The hour module of a wristwatch has always been the most valuable element of the assembly. Hence, the tendency has always been to make the straps, whether they be made of leather, fabric or metal, replaceable and comprised of two portions fastened to the module through fastening pins.

The various systems which have been adopted are so well known to all, that their enumeration here is of no interest.

Since some years ago, fashion has led to conceiving straps which are interchangeable rather than simply replaceable.

This new trend enables the user to match the strap to his or her other vestimentary elements.

Primarily, the difficulty encountered in the manufacture of interchangeable straps lies in the mode of adapation of the module to the strap.

Solutions, more or less original, have been proposed. The solutions which were the most satisfactory relied on a strap covered with stretched fabric, to which the module could be attached transversaly by various clip means.

Because of the requirements, the solutions which were proposed excluded their application to straps covered with leather or made of metal; the elasticity and the flexibility of the fabric were absolutely necessary for the attachment of the module.

In addition to this drawback concerning the material, the solutions which were proposed had the disadvantage of involving manipulations which, although they cannot be considered as complex, nevertheless require if not skill, at least patience.

SUMMARY OF THE INVENTION

The purpose of the present invention is to provide a wristwatch with a removable and interchangeable strap, which enables the use of leather as covering material and which is extremely simple to handle when making use of the interchangeable feature and when replacing one strap by another one.

To this end, the invention provides a wristwatch with a removable and interchangeable strap, comprising a clasp acting by co-operating male and female members, a single-piece strap connecting the two parts of the clasp, an hour module and means for fastening the hour module on the strap, characterized in that the strap comprises a recess, the shape of which corresponds to that of the hour module so as to provide a housing therefor, in that it further comprises at each extremity thereof, a groove designed for co-operating with a clamping member with which both of the two parts of the clasp are provided and in that the hour module comprises two toes designed for slidably co-operating with the profiled extremities of a ring fastener, in such a manner as to retain the module on the strap by the combined effect of the positioning of the module within its housing and of the clamping of the module in this position by the effect of the ring.

The male part of the clasp can comprise notches and the female part a member co-operating with said notches in such a manner as to vary the length of the strap from notch to notch, according to the more or less deeper penetration of the male part into the female part.

The clamping members, with which the two parts of the clasp are provided, can be excentrical pivoting clamps, the pressing part of which comprises an enlargement, the shape of which corresponds to that of the grooves provided at each extremity of the strap.

The ring fastener can have the shape of one half of a crown which fits onto one half of the hour module, and it can include at each extremity thereof, a U-shaped profile designed to press, on the one hand, against the lower surface of the strap and, on the other hand, against the toes of the module, the toes of the module and the profiled extremities of the ring being made to include male-female members, the co-operation of which maintains the module with a determined orientation, thus preventing the module from pivoting and from freeing its toes from the extremity of the ring.

The shape of the lower part of the module and that of the housing designed for receiving it, can include male-female members, intended for preventing the module from pivoting in the housing, so that, in the plane of the strap, the position of the module in the housing is entirely determined.

BRIEF DESCRIPTION OF THE DRAWINGS

The description which follows refers to the drawing, wherein.

DESCRIPTION OF THE PREFERRED EMBODIMENT

Figure 1:
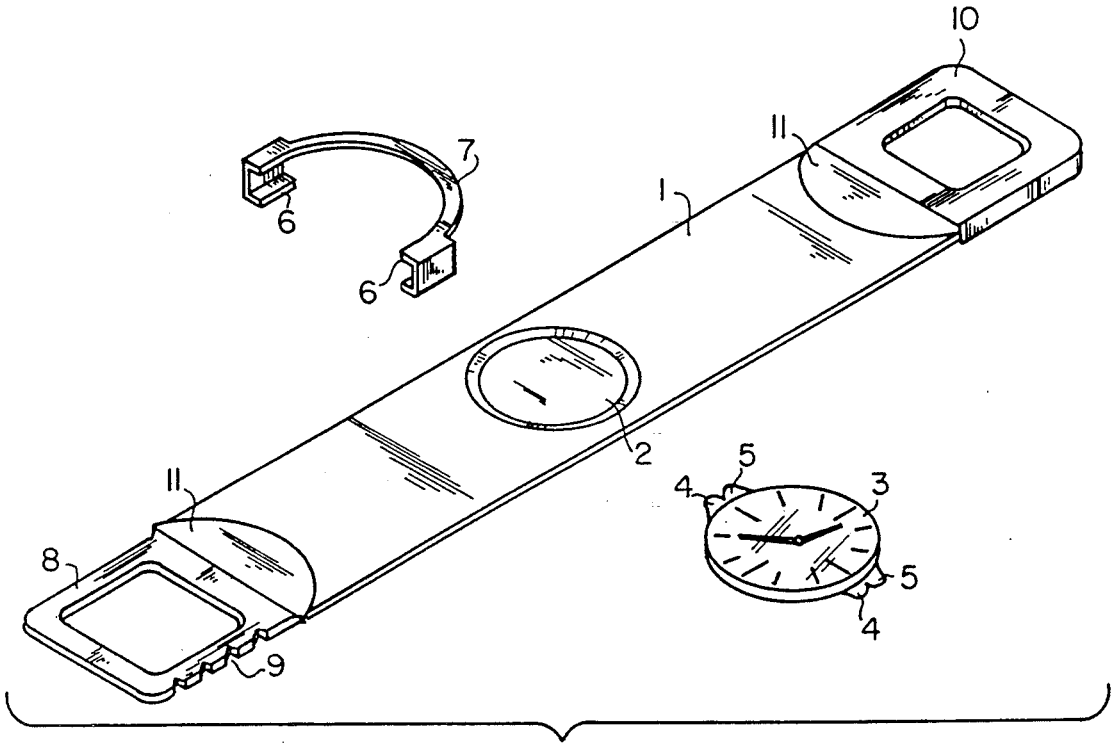
FIG. 1 represents an overall view, in which there are shown separately the three parts of the wristwatch.

One can see in FIG. 1 the strap 1 and its recess 2, which forms a housing for the hour module 3, which can be seen as having toes 4 provided with notches 5. The toes 4 are intended for co-operating with the extremities 6 of the fastener ring 7. These extremities 6 have a U-shaped profile, one of their branches pressing against the underside of the strap and the other, against the corresponding toe 4 of the module 3.

The notches 5 of the toes 4 are designed for co-operating with enlargements provided inside the extremities 6 of the ring 7. The co-operation of the enlargements, which are not shown in the drawing, but which one can imagine without difficulty, prevents the module from rotating on itself.

Figure 6:
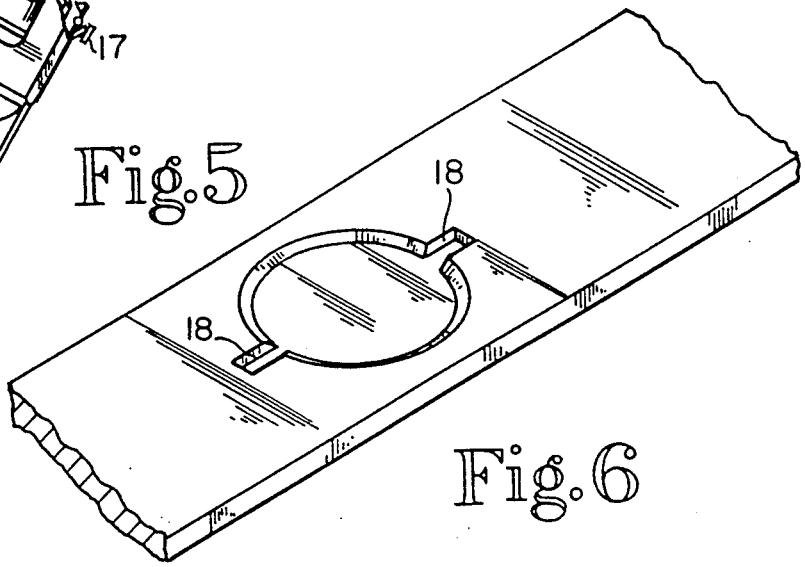
FIG. 6 illustrates a second proposed structure of the module and of its housing.

This function can be fulfilled in another manner, by adapting the shape of the housing to that of the module, as illustrated in FIG. 6.

Figure 5:
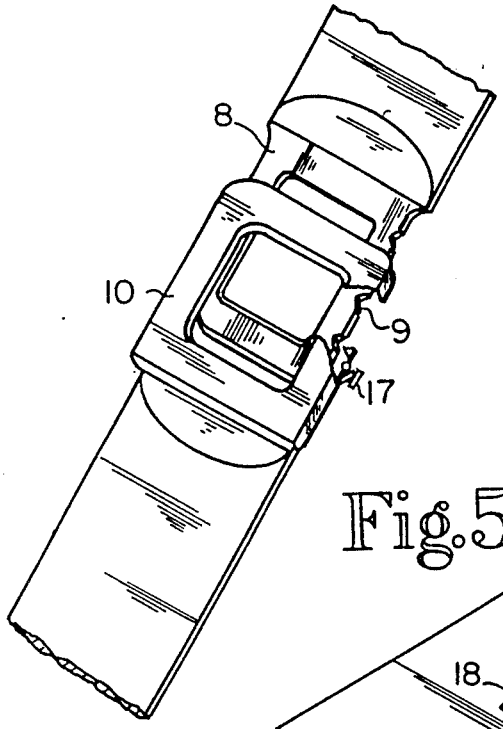
FIG. 5 illustrates more particularly the cooperation of the two parts of the clasp of the strap.

One can further note in FIG. 1 the two-part clasp, with the male part 8 comprising notches 9 and the female part 10 comprising a device designed for cooperating with the notches, and which is more particularly illustrated in FIG. 5.

Finally, one will note two excentrical clamps 11, which ensure the clamping and the fastening of the strap 1 to the two parts 8 and 10 of the clasp.

Figure 2:
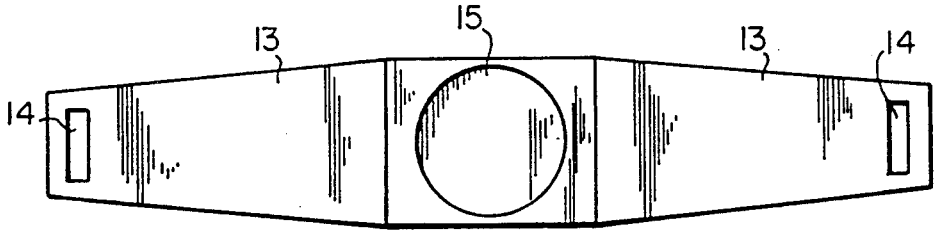
FIG. 2 illustrates the skeleton of the watch, before it is covered.

In FIG. 2, one can see the skeleton of the strap, before it is covered with leather. It is obvious that the strap can be covered with any other appropriate material, in particular fabric or plastic.

The skeleton of the wristwatch is comprised of three parts, which are distinct insofar as their properties are concerned, but which constitute physically a unit.

The first part 12, which occupies a mid position, is reinforced in such a manner as to provide some rigidity, for ensuring a better seating of the module inside its housing. The reinforcement can be realized by introducing a metal frame when molding the strap. The two parts 13 are similar to each other and are made of a material which is flexible but not deformable, such as plastic.

Figure 3:
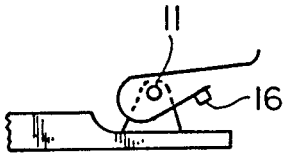
FIG. 3 illustrates more particularly the connecting device of the strap to the clasp.

At the extremities of the strap, one can note two slits or trenches 14 which co-operate with the excentrical clamps 11 and which are more particularly illustrated in FIG. 3.

Finally, one will note in the middle part 12 a hole 15, the diameter of which is selected according to that of the module.

The skeleton, as it is illustrated in FIG. 2, is thereafter covered with leather (or with another material, as was mentioned above), in such a manner that the covering fits closely to the shape of the skeleton. The covering is made integral with the skeleton, for example through adhesion.

Once the covering is in place, the hole 15 constitutes merely a recess, the adhesion of the two parts of the covering one on the other at that place providing a bottom. The same holds true for the two slots or trenches 14, which then form grooves. For completeness sake, one should also indicate that the upper part of the covering is pushed inside the holes and trenches to meet the lower part, which is not displaced.

In FIG. 3, there is illustrated the excentrical clamp 11, the functioning of which needs no comment, but which is provided in its pressing part, with an enlargement 16 designed for co-operating with the grooves 14, which have just been described.

Figure 4:
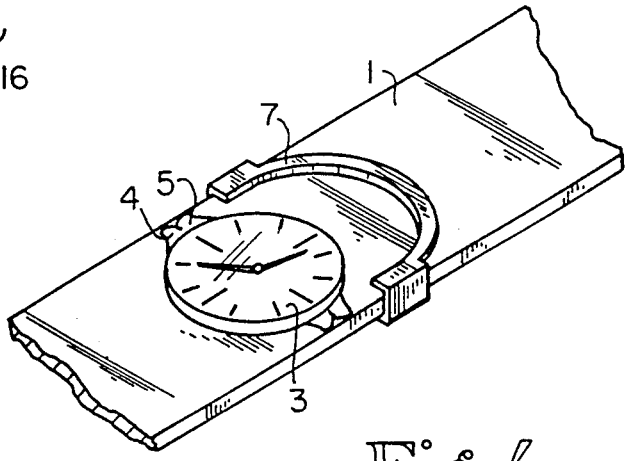
FIG. 4 illustrates the positioning of the module and of the ring fastener before they are made to cooperate.

In FIG. 4, one can see the strap 1 and the module 3 positioned in its housing. The ring fastener 7, held between the thumb and the forefinger of the user, can be brought slidably to its locking position. This position is indicated by the snapping of the enlargements provided inside the extremities of the ring, when penetrating inside the notches 5 of the toes 4 of the module 3.

By modifying the elasticity of the U profile, in combination with that offered by the covering of the strap, the module is applied against the strap and remains clamped thereto as long as the user does not remove the ring fastener through the opposite operation.

FIG. 5 illustrates how the two parts 8 and 10 of the clasp co-operate. In particular, one will note the notches 9 and the rotatable push-piece 17, which is shown only very schematically in the drawing, the purpose here not being to elaborate on its presence and on its function; which are, incidentally, well known.

Finally, FIG. 6 illustrates a solution for ensuring the immobilization of the module, which provides an alternative to the notches 5; the shape of the identations 18 being chosen freely, while ensuring that the lower part of the module is provided with toes of the corresponding shape.

The advantages of the wristwatch according to the invention are, objectively, to enable the use of leather as covering material and to require a very simple manipulation when changing the strap. The use of leather enables, while retaining the interchangeable feature, to rehabilitate the use on a noble material, with which watches have been for long associated. The simplicity of the exchange of straps is quite an appreciable advantage, and one can verify that the user only needs his fingers to carry it out. Actually, he only has to depress the push-piece of the clasp to open it, and to remove his watch. Thereafter, he removes slidably the ring fastener simply by pulling at both extremities. Then, he only has to remove the module, to free the two excentrical clamps and to choose another strap. All these operations are so simple, that one can carry them out easily even blindfolded.

The subjective advantage of the wristwatch according to the invention is that it allows the matching not only of colours, but also of materials, since belts, shoes and handbags are traditionally made of leather.

I claim:

1. A wristwatch with a removable and interchangeable strap, said wristwatch comprising a single-piece strap provided with means for securing its ends together and with a recess for accommodating an hour module, said hour module comprising two projections which extend laterally in substantially opposite positions, so as to rest over the upper face of the strap between the hour module and the side edges of the strap, and a flat fastening member provided with clamping means arranged for cooperating with said projections of the hour module, said fastening member being slidably mounted over the strap, so as to be able to be displaced between an unlocking position, in which said member is located between the housing of the hour module and one of the extremities of the strap with its clamping means disengaged from the said projections of the hour module, and a locking position in which the clamping means cooperate with the projections of the hour module so as to retain the module in its said housing on the strap and wherein said fastening member comprises an elongated part delimited on its side facing the recess provided on the strap for lodging the hour module, by an edge having a shape matching the shape of the hour module, each extremity of said elongated part being connected to a U-shaped profile straddling one of the side edges of the strap.

2. A wristwatch according to claim 1, wherein the hour module is of circular shape and said edge of the elongated part of the fastening member is semi-circular.

3. A wristwatch according to claim 1, wherein each of the projections of the hour module consists of a notched toe, and the inner surface of each of said U-shaped profile is provided with a projecting member arranged for cooperation with the notches of the corresponding toe, so as to allow snapping engagement of said U-shaped profile with said toe.

4. A wristwatch according to claim 1, wherein the shape of the lower part of the module and that of the housing designed for receiving it include matching male-female formations cooperating together for preventing rotation of the module in the housing.

* * * * *